US007866079B2

(12) United States Patent
Keeney et al.

(10) Patent No.: US 7,866,079 B2
(45) Date of Patent: Jan. 11, 2011

(54) MODULAR BARREL ASSEMBLY

(75) Inventors: Michael D. Keeney, Rineyville, KY (US); Marlin R. Jiranek, II, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 388 days.

(21) Appl. No.: 11/971,402

(22) Filed: Jan. 9, 2008

(65) Prior Publication Data

US 2010/0281743 A1 Nov. 11, 2010

Related U.S. Application Data

(63) Continuation of application No. 10/920,929, filed on Aug. 18, 2004, now abandoned.

(60) Provisional application No. 60/498,567, filed on Aug. 28, 2003, provisional application No. 60/501,884, filed on Sep. 10, 2003.

(51) Int. Cl.
*F41C 27/00* (2006.01)

(52) U.S. Cl. ..... 42/76.1; 42/76.02; 42/76.01; 89/14.7; 89/14.05; 89/16

(58) Field of Classification Search ..... 42/76.02, 42/76.01, 76.1, 75.1; 89/14.7, 14.05, 16
See application file for complete search history.

(56) References Cited

U.S. PATENT DOCUMENTS 337,916 A * 3/1886 Ballard ..... 42/76.01
496,637 A 5/1893 Brown
685,669 A * 10/1901 Broyles ..... 42/79
1,013,974 A * 1/1912 Vandenbossche ..... 42/79
1,169,543 A 1/1916 Johnson
1,065,341 A 6/1918 Browning
1,297,891 A * 3/1919 Moor ..... 42/77
1,355,419 A * 10/1920 Pedersen ..... 89/145
1,373,888 A 4/1921 Johnson
1,605,741 A * 11/1926 Jones ..... 42/79
2,137,259 A * 11/1938 Boak ..... 42/76.02
2,423,471 A * 7/1947 Summerbell ..... 89/29
2,663,410 A * 12/1953 Kessler ..... 72/276
2,669,052 A * 2/1954 Simmons ..... 42/76.01
2,685,654 A 8/1954 Mennesson (Continued)

FOREIGN PATENT DOCUMENTS

CA 1 167 676 5/1984

(Continued)

OTHER PUBLICATIONS

Letter from Tom Chace to Remington Arms (With enclosures) (Jan. 6, 2004).

(Continued)

*Primary Examiner*—Michelle Clement
(74) *Attorney, Agent, or Firm*—Womble Carlyle Sandridge & Rice, PLLC

(57) ABSTRACT

A modular barrel assembly for firearms that includes a breech section formed from a high-strength material and a barrel section. the barrel section generally is formed separately from the breech section and can be formed from a different, lighter-weight material. Once formed, the barrel and breech sections are attached together to form the complete barrel assembly.

22 Claims, 3 Drawing Sheets

U.S. PATENT DOCUMENTS

| | | | | | |
|---|---|---|---|---|---|
| 2,736,118 | A | * | 2/1956 | Clarkson et al. | 42/75.02 |
| 2,736,119 | A | * | 2/1956 | Clarkson et al. | 42/75.02 |
| 2,742,821 | A | * | 4/1956 | Sweetman | 89/14.05 |
| 2,747,313 | A | | 5/1956 | Crittendon et al. | |
| 2,775,164 | A | * | 12/1956 | Aslund et al. | 89/16 |
| 2,847,786 | A | | 8/1958 | Hartley et al. | |
| 2,882,796 | A | * | 4/1959 | Clark et al. | 89/7 |
| 2,917,809 | A | * | 12/1959 | Braatz | 42/78 |
| 2,935,913 | A | | 5/1960 | Wilson | |
| 3,118,243 | A | | 1/1964 | Manshel | |
| 3,138,889 | A | * | 6/1964 | Groover | 42/77 |
| 3,150,458 | A | | 9/1964 | Browning | |
| 3,177,603 | A | | 4/1965 | Gillespie | |
| 3,208,178 | A | | 9/1965 | Seiderman | |
| 3,339,304 | A | | 9/1967 | Knode et al. | |
| 3,496,667 | A | * | 2/1970 | Lowry | 42/78 |
| 3,517,585 | A | | 6/1970 | Slade | |
| 3,731,418 | A | | 5/1973 | Birkenhagen et al. | |
| 3,765,302 | A | * | 10/1973 | Browning | 89/193 |
| 3,877,167 | A | | 4/1975 | Keppeler | |
| 4,087,930 | A | * | 5/1978 | Grehl | 42/75.02 |
| 4,126,077 | A | * | 11/1978 | Quesnel | 89/1.704 |
| 4,211,146 | A | | 7/1980 | Bradley | |
| 4,238,540 | A | | 12/1980 | Yates et al. | |
| 4,316,339 | A | | 2/1982 | Herriott | |
| 4,368,589 | A | * | 1/1983 | A'Costa | 42/77 |
| 4,485,721 | A | | 12/1984 | Shankhla et al. | |
| 4,494,332 | A | * | 1/1985 | Matievich | 42/77 |
| 4,546,564 | A | * | 10/1985 | A'Costa | 42/76.01 |
| H82 | H | | 7/1986 | Dittrich et al. | |
| 4,646,615 | A | | 3/1987 | Gladstone et al. | |
| 4,685,236 | A | | 8/1987 | May | |
| 4,713,903 | A | * | 12/1987 | Mainland | 42/79 |
| 4,729,806 | A | | 3/1988 | Stein | |
| 4,769,938 | A | | 9/1988 | Chesnut et al. | |
| 4,833,810 | A | * | 5/1989 | Domian | 42/59 |
| 4,841,657 | A | * | 6/1989 | Mossberg | 42/76.01 |
| 4,892,764 | A | * | 1/1990 | Drain et al. | 428/34.5 |
| 4,989,359 | A | * | 2/1991 | Kinkner et al. | 42/77 |
| 5,018,293 | A | * | 5/1991 | Mainland | 42/77 |
| 5,054,224 | A | | 10/1991 | Friar et al. | |
| 5,125,179 | A | * | 6/1992 | Campbell et al. | 42/76.02 |
| 5,155,291 | A | * | 10/1992 | Dabrowski | 89/14.05 |
| 5,157,211 | A | * | 10/1992 | Mossberg | 42/79 |
| 5,196,637 | A | | 3/1993 | Petrovich | |
| 5,212,328 | A | | 5/1993 | Petrovich | |
| 5,341,719 | A | | 8/1994 | Bullis | |
| 5,348,598 | A | | 9/1994 | Vives | |
| H1365 | H | | 11/1994 | Amspacker et al. | |
| 5,394,633 | A | * | 3/1995 | Alessandri, Jr. | 42/79 |
| 5,394,634 | A | * | 3/1995 | Vang et al. | 42/79 |
| 5,410,796 | A | * | 5/1995 | Weeks, Jr. | 29/419.1 |
| 5,448,848 | A | | 9/1995 | Moller | |
| 5,479,737 | A | | 1/1996 | Osborne et al. | |
| 5,581,928 | A | * | 12/1996 | Krumm et al. | 42/76.01 |
| 5,600,912 | A | | 2/1997 | Smith | |
| 5,657,568 | A | | 8/1997 | Christensen | |
| 5,666,756 | A | | 9/1997 | Moller | |
| 5,685,102 | A | * | 11/1997 | Latka | 42/85 |
| 5,692,334 | A | | 12/1997 | Christensen | |
| 5,706,599 | A | * | 1/1998 | Knight | 42/75.02 |
| 5,804,756 | A | * | 9/1998 | Christensen | 89/15 |
| 5,856,631 | A | | 1/1999 | Julien | |
| 5,872,323 | A | | 2/1999 | Norton | |
| 5,907,919 | A | | 6/1999 | Keeney | |
| 6,123,007 | A | | 9/2000 | O'Dwyer | |
| 6,189,431 | B1 | | 2/2001 | Danner et al. | |
| 6,289,620 | B1 | * | 9/2001 | Doria | 49/79 |
| 6,357,331 | B1 | * | 3/2002 | Dionne | 89/29 |
| 6,457,274 | B2 | * | 10/2002 | Smith | 42/76.02 |
| 6,482,248 | B1 | * | 11/2002 | Holloway | 75/249 |
| 6,497,065 | B1 | | 12/2002 | Huston | |
| 6,564,689 | B1 | * | 5/2003 | Billgren | 89/16 |
| 6,574,898 | B2 | | 6/2003 | Spencer et al. | |
| 6,615,702 | B1 | * | 9/2003 | Julien | 89/16 |
| 6,655,372 | B1 | | 12/2003 | Field et al. | |
| 6,758,004 | B2 | * | 7/2004 | Huston | 42/76.02 |
| 6,789,454 | B2 | | 9/2004 | Smith | |
| 6,889,464 | B2 | | 5/2005 | Degerness | |
| 6,990,764 | B2 | * | 1/2006 | Walker | 42/79 |
| 7,076,904 | B1 | * | 7/2006 | Rustick | 42/75.02 |
| 2005/0108916 | A1 | | 5/2005 | Keeney et al. | |
| 2007/0256345 | A1 | * | 11/2007 | Hall et al. | 42/76.1 |

FOREIGN PATENT DOCUMENTS

| | | | | |
|---|---|---|---|---|
| CH | 682843 | A5 | * | 11/1993 |
| DE | 2 225 531 | | | 5/1972 |
| DE | 29619652 | U1 | * | 4/1997 |
| WO | WO 2005/033614 | | | 4/2005 |

OTHER PUBLICATIONS

European Supplementary Search Report for Patent Application No. 04 809 635.8 (Feb. 27, 2007).

Office Action mailed Jun. 14, 2005 for parent U.S. Appl. No. 10/920,929.

Amendment filed Oct. 13, 2005 for parenet U.S. Appl. No. 10/920,929.

Restriction Requirement mailed Dec. 30, 2005 for parent U.S. Appl. No. 10/920,929.

Response to Restriction Requirement dated Jan. 25, 2006 for parent U.S. Appl. No. 10/920,929.

Final Office Action mailed Apr. 19, 2006 for parent U.S. Appl. No. 10/920,929.

Amendment, Extension of Time and RCE dated Aug. 16, 2006 for parent U.S. Appl. No. 10/920,929.

First Office Action after RCE mailed Nov. 2, 2006 for parent U.S. Appl. No. 10/920, 929.

Amendment dated Mar. 2, 2007 for parent U.S. Appl. No. 10/920,929.

Final Office Action after RCE mailed May 11, 2007 for parent U.S. Appl. No. 10/920,929.

Amendment after Final Office Action dated Aug. 13, 2007 for parent U.S. Appl. No. 10/920,929.

Advisory Action mailed Aug. 23, 2007 for parent U.S. Appl. No. 10/920,929.

Second Amendment after Final Office Action dated Sep. 26, 2007 for parent U.S. Appl. No. 10/920,929.

Notice of Appeal, Extension of Time mail dated Oct. 10, 2007 for parent U.S. Appl. No. 10/920,929.

Amendment after Notice of Appeal dated Jan. 8, 2008 for parent U.S. Appl. No. 10/920,929.

Advisory Action dated Apr. 18, 2008 for parent U.S. Appl. No. 10/920,929.

Notice of Abandonment dated Jun. 2, 2008 for parent U.S. Appl. No. 10/920,929.

* cited by examiner

MODULAR BARREL ASSEMBLY

CROSS REFERENCE TO RELATED APPLICATIONS

This application is a continuation of application Ser. No. 10/920,929, filed Aug. 18, 2004, which claims the benefit of U.S. Provisional Application No. 60/498,567, entitled "Modular Barrel Assembly", filed Aug. 28, 2003, and U.S. Provisional Application No. 60/501,884, entitled "Method of Forming Composite Barrel", filed Sep. 10, 2003, all of the listed applications being incorporated herein by reference in their entireties.

FIELD OF THE INVENTION

The present invention generally relates to firearms, and in particular, to a modular barrel assembly for firearms.

BACKGROUND OF THE INVENTION

In the manufacture of firearms, and in particular long guns including rifles and shotguns, the production of gun barrels has been performed by a variety of different methods, all of which generally produce a continuous tube. Typically, the tube is formed from a high strength material, such as alloy steel, so as to be capable of withstanding the extreme internal pressures generated during the discharge of a round of ammunition. For example, with the discharge of a shotgun shell, internal chamber pressures in excess of 10,000-15,000 psi can be generated in the chamber and breech sections of the firearm. Firearm barrels typically consist of a chamber or breech region in which the round of ammunition or shell is inserted, and a barrel tube defining the bore of the barrel. Shotgun barrels further typically include a choke section along the barrel, in which a removable choke tube can be received. Externally, the size and length of the barrel tube can vary depending upon the type of firearm, but usually is tapered from the breech or chamber region toward the muzzle end of the barrel in an effort to optimize barrel thickness and weight based on bore pressure variations/reductions as the shot progresses away from the chamber region.

Due to the significant taper or reduction in wall thickness of most typical gun barrels, and in particular shotgun barrels, it is generally not cost effective to machine or cut-down a solid bar or tube having a uniform cross-section to provide the desired taper and reduce the weight of the barrel. Consequently, most firearm barrels typically are hammer forged from shorter blanks to form tapered walled tubes between 20-34 inches in length. Although more cost effective than machining, such forging operations still typically require significant effort and processing to try to ensure straightness of the bore and concentricity of the bore to the outside surface of the barrel. More recently, various composite materials also have been used to form firearm barrels, such as for shotguns, but typically have required a metal liner along their inner wall for protection, thus adding to their cost in terms of both materials and manufacturing.

Accordingly, it can be seen that a need exists for a method and system for forming barrel assemblies for firearms that addresses the foregoing and other related and unrelated problems in the art.

SUMMARY

Briefly described, the present invention generally relates to a modular barrel assembly for firearms such as rifles, shotguns and other long guns, and potentially handguns as well. The barrel assembly generally will include a breech or upstream section that generally mounts to the receiver or frame of the firearm, in communication with the chamber of the firearm for receiving a round of ammunition, and a barrel section that attaches to and extends down-bore from the breech section. Typically, the breech section will be formed from a high strength material such as steel, although other high strength materials also can be used, using a forging or machining type process.

The barrel section can be manufactured separately as part of a different manufacturing process than the breech section. The barrel section further can be formed in a variety of different lengths, and can be made interchangeable with other varying length barrel sections. The barrel section generally will include a barrel connector, which typically is formed from a metal material such as steel, similar to the breech section, and a bore tube or section attached to the opposite end thereof. The bore tube or section can be formed from a variety of lighter weight materials, including aluminum, steel, various lighter weight metal alloys and even synthetic and composite materials such as carbon, glass or other fiber composites, and ceramics. The bore section further can be formed using a variety of different processes, depending upon the materials being used therefor, such as, for example, using a roll wrapping, filament winding, or pultrusion type processes for composite or synthetic materials such as carbon fiber, or rolling or extruding where other types of material, such as metals, are used. The bore section generally will be connected to the barrel connector such as by an adhesive, although other types of chemical, mechanical, and/or metallurgical bonding techniques also can be used. A rib also can be formed with or can be attached to the bore section to provide added stiffness for the barrel assembly. Still further, a muzzle insert, typically formed from a metal such as steel or other similar material, can be attached to the down bore end of the bore section.

The breech and barrel sections of the barrel assembly of the present invention generally will be attached together in a downstream assembly step. The barrel and breech sections can be attached together using metallurgical (welding, brazing, fusing, soldering, etc.), and/or chemical (adhesives) bonding techniques. Still further, it is also possible to mechanically attach the barrel and breech sections together (such as via fasteners; a threaded connection between the breech section and the barrel connector; or through a press-fit arrangement between the two sections and use of a locking ring) so as to enable removal and replacement or interchangeability of the barrel and/or the breech sections of the barrel assembly.

Various objects, features and advantages of the present invention that will become apparent to those skilled in the art upon reading the following detailed description, when taken in conjunction with accompanying drawings.

DESCRIPTION OF THE INVENTION

Figure 1:
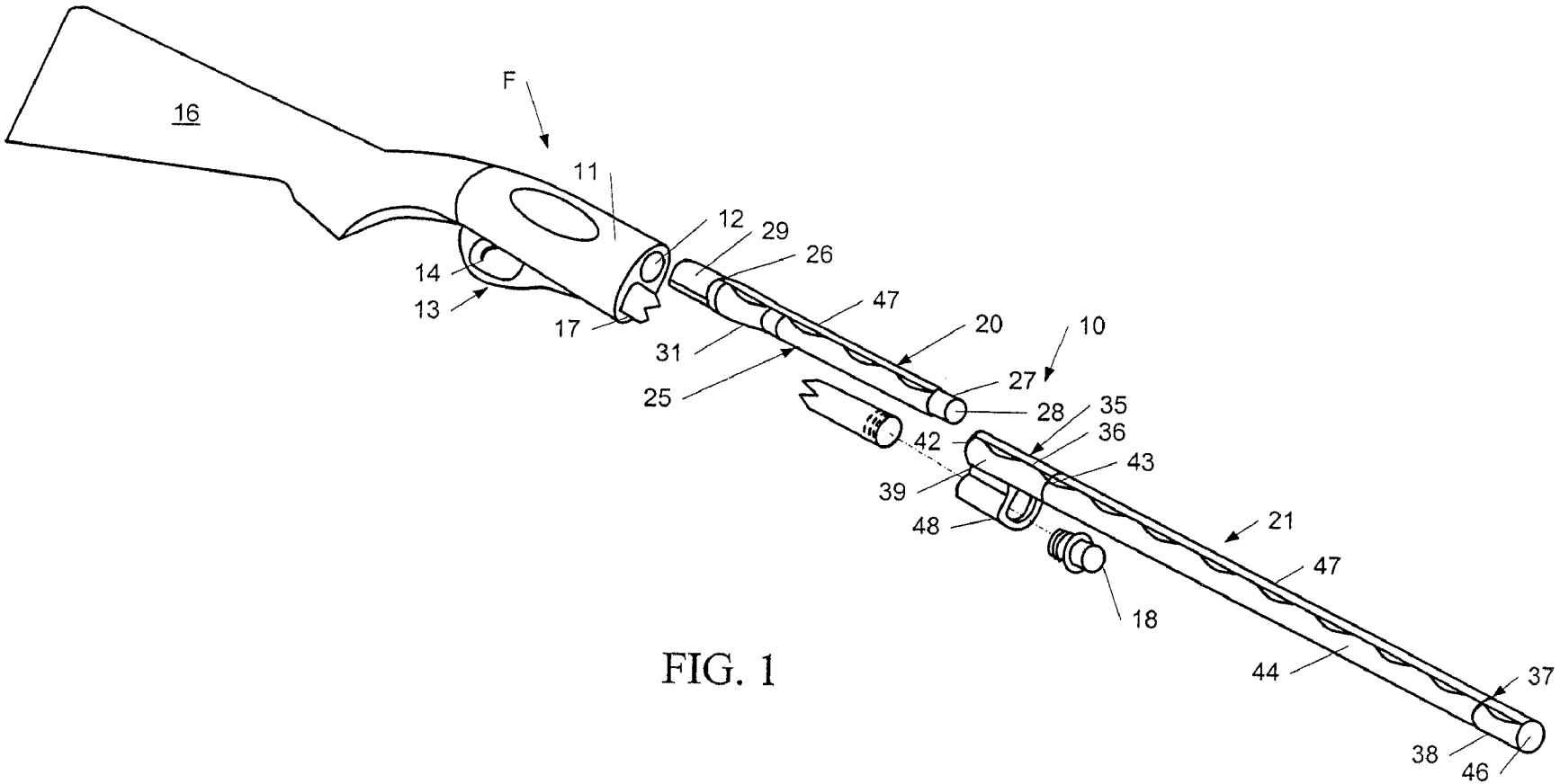
FIG. 1 is a perspective illustration of an example embodiment of a firearm incorporating the modular barrel assembly of the present invention.

The present invention relates to a modular barrel assembly 10 (FIG. 1) for a firearm F, which generally will be manufactured in multiple sections or portions using various different materials so as to reduce manufacturing costs, scrap attributed to straightness and concentricity issues for forming the barrel assembly, while also enabling significant weight reduction without adversely affecting performance of the firearm. In one example embodiment, for purposes of illustration, the barrel assembly 10 of the present invention is shown in FIG. 1 as being part of a shotgun F having a receiver 11, including a forward portion at which a chamber 12 of the firearm is defined; a fire control 13 including trigger 14; a stock 16; a magazine tube 17; and a magazine cap 18. It will however, be understood that the principles of the present invention also can be used to form a modular barrel assembly for various other types of firearms, including rifles and other long guns, as well as potentially for hand guns.

Figure 2:
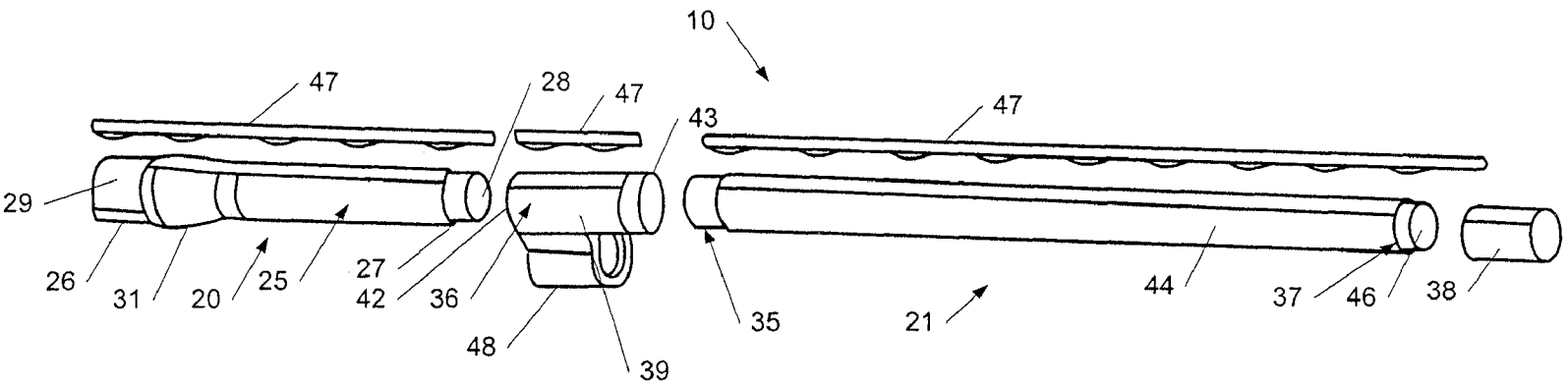
FIG. 2 is a perspective view schematically illustrating the interconnection of the elements of the modular barrel assembly of the present invention.
Figure 3:
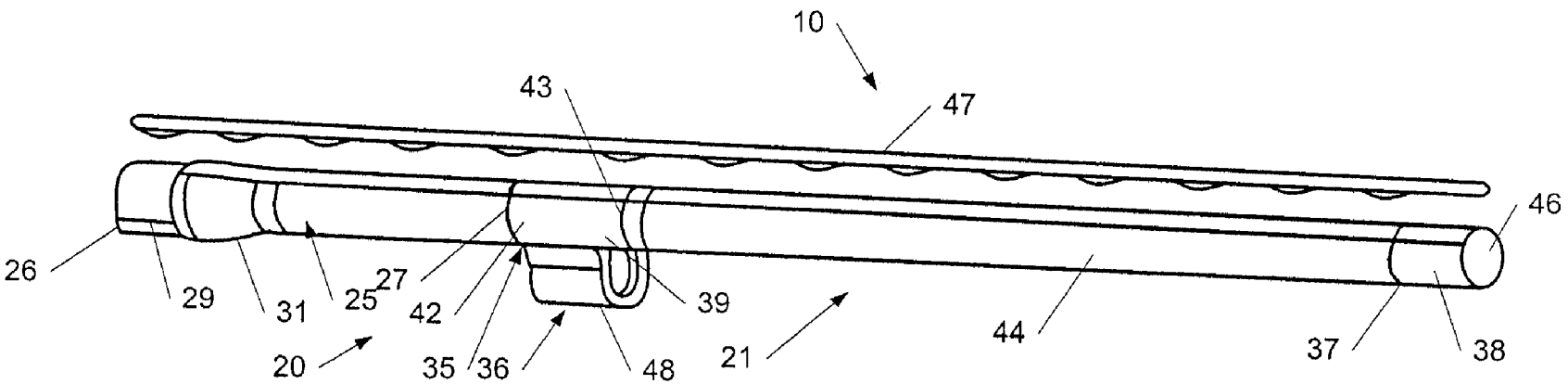
FIG. 3 is a perspective illustration showing a completed modular barrel assembly according to the present invention.

As illustrated in FIGS. 1-3, the barrel assembly 10 of the present invention generally will include a breech section or region 20 that will be attached to and communicate with a mating portion of the chamber 12 of the firearm receiver 11, as shown in FIG. 1, and a barrel section 21 that connects to and projects forwardly, and down-bore from the breech section 20 and receiver 11. Typically, the breech and barrel sections will be manufactured separately and later assembled together to form a completed modular barrel assembly 10 as shown in FIG. 3.

The breech section 20 generally will be manufactured from a high strength material, such as steel, titanium, or other similar high strength, rigid, durable metals or metal alloys, since the breech section generally will be subjected to the highest internal chamber pressures resulting from the ignition of the propellants in a round of ammunition, such as a bullet or shot shell, during firing of the firearm. As indicated in FIGS. 1 and 2, the breech section typically will be approximately 8-10 inches, or approximately ¼ to ⅓ the length of a completed barrel assembly 10, although the breech section also can be formed in greater or lesser lengths as needed. The breech section further typically can be forged from a metal blank or tube, such as conventionally used to manufacture entire barrel assemblies. However, given the reduced size of the breech section, the forging operations required to form the breech section accordingly can be significantly reduced. In addition, since the breech section 20 is significantly shorter than a conventional barrel, it can also be machined from a uniform cross-section tube or bar without significant material removal from the tube being required.

As further indicated in 1-3, the breech section 20 generally includes an elongated tubular body 25 having a first or rear end 26, a second or forward end 27, and defines a bore passage 28 therethrough. The rear end 26 of the breech section generally is formed as a collar or sleeve 29 having an enlarged or expanded diameter that tapers, as indicated at 31, toward the forward end 27 of the breech section. The rear end 26 of the breech section is adapted to engage and mate with the receiver 11 of the firearm F, as indicated in FIG. 1, with the chamber 12 of the receiver being aligned and in communication with the bore passage 28 extending through the breech section 20. The rear end of the breech section 20 typically will engage and fit against the receiver in a generally tight press-fitted arrangement, secured against the forward face of the receiver as shown in FIG. 1.

As illustrated in FIGS. 1 and 2, the barrel section 21 generally will be manufactured separately from the breech section 20, typically using different manufacturing process than the breech section. The barrel section generally will comprise the longest part of the barrel assembly and can be formed in a variety of different lengths as needed for different applications or firearms. For instance, a shorter barrel length may be used for firing shot shells to provide a wider pattern dispersion, while longer barrel lengths may be used in applications where bullets or slugs are used. The barrel section can also be interchangeable so as to enable change-out of the barrel section to fit different applications as needed or desired.

FIG. 2 further illustrates various components of the barrel section 21, which generally includes first end 35 at which a barrel connector 36 is mounted and which mates with the tapered forward end 27 of the breech section 20 for connecting the barrel section 21 to the breech section 20 to form the completed barrel assembly 10 as shown in FIG. 3; and a second end or muzzle portion 37 that can receive a muzzle insert 38 therein. As shown in FIGS. 1 and 2, the barrel connector 36 generally includes a tubular body 39 defining a bore 41 therethrough and has a first or rear end 42 and a second or forward end 43. The barrel section 21 further includes a bore tube or section 44 that can be formed in different or varying lengths and further can be formed with internal rifling along its bore 46 that extends therethrough and which is aligned with the bore 28 of the breech section when assembled with the breech section.

Since the pressure containment requirements of the bore tube or section 39 of the barrel section 21 generally will be lower than the breech section 20, the bore tube 39 can be made from a variety of different, lighter-weight, materials than the breech section. For example, various metals including steel, aluminum, and/or lightweight, durable metals or metal alloys typically are formed by forging or machining a tube of a desired length. Since there generally is a minimal taper to the bore tube, and lighter-weight metal materials can be used, less forging or machining, and thus less scrap, typically will be required to form the bore tube from such a metal material. Alternatively, for more significant weight reduction, the bore tube 39 also can be formed from various synthetic or composite materials such as fibrous material, including carbon, glass, graphite, boron, nickel coated carbon, and/or silicon carbon fiber, and resin composites, ceramics, various high strength plastics, nylon and/or other similar, rigid, durable materials. Example resins could include epoxy resins, polylimide resins, polyester resins, thermoplastic resins and/or other, similar resin materials. The formation of such a composite or synthetic bore tube can be accomplished with a variety of manufacturing techniques including filament winding, pultrusion, and roll-wrapping processes.

In an example of a roll-wrapping process, a series of layers, typically 3-4 or more layers or strips of a unidirectional or balanced ply fabric material, such as a carbon fiber ribbon or similar composite fabric material will be laid out in stacked layers. Typically, a unidirectional pre-impregnated (prepreg) fabric in which essentially all of the fibers of the composite fiber fabric are pre-impregnated with an uncured resin will be used, with a majority of fibers or filaments of the fabric material bound in the hoop direction (approximately 90° to the axis of the bore 41, extending through the bore tube) and with the remaining oriented longitudinally, substantially parallel to the axis of the bore 41 so as to provide additional longitudinal stability and tensile strength, or at varying angles, such as approximately 45° with respect to the axis of the bore so as to provide further torsional stability to the bore tube. Dry fabrics can also be used with the resin materials to be applied during later processing at a later step. A mandrel, which will form the inside diameter and surface of the bore tube, generally is placed at one end of the stack or plies or layers of fabric material. The fabric assembly then is rolled tightly around the mandrel, such as by using a table having a fixed plate and moveable plate that exert a load or compressive force on the stacked fabric layers therebetween. The moveable plate will be slid in a direction perpendicular to the axis of the mandrel, causing the mandrel to roll the plies or layers of the fabric material onto the mandrel under constant pressure to form a composite bar or tube, with the mandrel in its center.

The composite bar or tube is then wrapped with a clear ribbon or tape material, to maintain compressive stresses about the exterior of the bar. The whole assembly is then cured, typically by placement in a curing oven and being subjected to temperatures of upwardly of 325° F. for approximately 2 hours, or at other temperatures and for other times as may be necessary to cure the resin material applied to the layers. Alternatively, the resin material can be chemically cured, such as by amine/epoxy, anhydride/epoxide and/or acid-catalyzed epoxide reactions. The mandrel is then extracted from the cured bar, leaving the composite bore tube. The exterior of the bore tube then generally is finished, such as by sanding or grinding the exterior wall of the tube, to provide a smooth, flat finish, after which a clear coat typically is applied.

Alternatively, a composite or synthetic bore tube can be manufactured using a filament winding process in which strips or layers of a unidirectional fabric material are wound together using a filament winding machine. During this process, the winding can be stopped periodically for application of additional layers of a unidirectional fabric, which typically are hand laid onto the assembly to achieve a zero degree orientation of the layers in the composite pre-form.

As a further alternative, a composite or synthetic bore tube can be formed using a pultrusion method in which a composite material, such as a ceramic or fibrous material having a resin applied thereto, will be pulled through a heated die that serves to further cure the composite material, to thus form a tube of a desired length. Such a process is generally can yield the lowest cost per unit length; however, it typically will not provide the same levels of strength in the finished bore tube as provided with roll-wrapping or winding methods.

The barrel connector 36 and muzzle insert 38 typically will be formed form a standard alloy, steel, aluminum, or other metal material similar to the breech section. The barrel connector 36 and muzzle insert 38 can be attached to the bore tube at the opposite ends thereof by various chemical methods of attachment, including use of various types of epoxies, resins and/or other adhesive materials for adhesively attaching the barrel connector and muzzle insert to the composite material of the bore section. Additionally, various other types or methods of attachment also can be used, including, but not limited to, welding; fusing; brazing; soldering or other metallurgical methods of attachment; and/or various mechanical attachments, such as through the use of fasteners, such as screws, pins, rods, banding materials, a threaded connection between the barrel connector and bore tube, press fitting the sections together, and/or other, similar connectors.

In addition, as shown in FIG. 2, a ventilated rib 47 can be mounted along the breech and barrel sections for added stiffness or rigidity. The ventilated rib component 12 can be constructed in a piece (FIG. 3) or in multiple sections (FIGS. 1 and 2), and can be formed from various materials such as aluminum or other metals, or from various synthetic composite materials such as carbon fiber similar to the bore tube 39 for lighter weight. The rib component 47 can be affixed or attached to the breech and barrel sections by the use of an epoxy or similar adhesive material, fusing, welding, brazing (i.e., for attaching a metal rib to a metal bore tube and breech section), fasteners, or it can be formed with the bore tube of the barrel section during manufacture of the bore tube.

To assemble the barrel assembly of the present invention, the barrel section will be attached to the breech section, as indicated in FIGS. 2 and 3, with the tapered forward end 14 of the breech section 11 generally being received with a tight fitting engagement within the open rear end 42 of the body 39 of the barrel connector 36 and with their rib component sections 47 aligned. Typically, breech and barrel sections of the barrel assembly 10 can be metallurgically attached, such as by welding, fusing, brazing, soldering, or similar attachments; mechanically attached through the use of fasteners such as pins, rods, screws, banding materials, threaded connections between the sections, and/or other, similar connectors; or chemically bonded or attached together through the use of epoxies, resins, or other adhesive materials. As a result, the breech and barrel sections can be fixedly attached to one another to form the completed barrel assembly 10, as indicated in FIG. 3.

In addition, for a barrel assembly for a shotgun, such as generally illustrated in FIGS. 1 and 2, the barrel connector 36 can include a locking ring 48 along its lower portion in which one end of the magazine tube 17 will be received, as shown in FIG. 1, with the magazine cap 18 generally being screwed or otherwise affixed to the magazine plug to secure the barrel assembly to the receiver of the firearm. The engagement of the cap 18 with the magazine tube 17 at the locking ring 48 thus secures the breech and barrel sections of the barrel assembly 10 together in a tight fitting, engaged relationship to prevent blowback or gas leakage. Such a connection further can enable quick and easy replacement of the barrel section of the barrel, without having to replace the entire barrel of the firearm.

It will be understood by those skilled in the art that the principles of the present invention can be adapted to formation of barrel assemblies for a variety of different firearms, including rifles, shotguns and other long guns, as well as potentially to handguns as needed or desired. The module barrel system of the present invention thus enables the interchangeability of firearm barrels for quick conversion of a firearm to fire different types of rounds of ammunition, such as shot shells, rifle slugs, etc., and to provide ease of repair and replacement for a firearm barrel as needed. The present invention further enables the use of lighter weight materials during the manufacture of a barrel assembly, which enables a significant cost and weight reductions for the barrel assembly and thus its firearm, as well as ease of manufacture for the barrel assembly.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. A method of making a shotgun, comprising:

forming a tapered breech section, wherein forming the tapered breech section comprises machining a metallic tube;

forming a shotgun barrel section including a composite bore tube;

attaching a barrel connector at a downbore end of the breech section to a rear end of the composite bore tube of the barrel section, wherein the barrel connector includes a locking ring;

attaching a rear end of the breech section to a receiver so that a chamber of the receiver is in communication with the breech section; and mounting a magazine tube to the barrel assembly using the locking ring.

2. The method of claim 1, wherein the breech section and the barrel section form a barrel assembly having a length, a length of the breech section being between one quarter to one third the length of the barrel assembly.

3. The method of claim 2, wherein the length of the breech section is between eight to ten inches.

4. The method of claim 2, further comprising:

inserting a muzzle insert at a muzzle end of the barrel section;

mounting a magazine tube to the barrel assembly using a locking ring; and mounting a ventilated rib on the barrel section.

5. The method of claim 1, wherein forming a tapered breech section comprises machining a metallic tube of uniform cross-section.

6. The method of claim 1, further comprising inserting a muzzle insert at a muzzle end of the barrel section.

7. The method of claim 1, further comprising mounting a ventilated rib section on the barrel section.

8. The method of claim 1, further comprising mounting a magazine tube to the barrel assembly using a locking ring.

9. The method of claim 1, wherein forming the barrel section comprises at least one of roll wrapping, pultrusion, and winding together strips of a unidirectional fabric material about a mandrel.

10. The method of claim 1, wherein the composite bore tube is attached to the barrel connector with adhesive.

11. A method of making a shotgun, comprising:

forming a tapered breech section, wherein forming the tapered breech section comprises machining a metallic tube;

forming a shotgun barrel section including a composite bore tube;

attaching a downbore end of the breech section to a rear end of the barrel section; and attaching a rear end of the breech section to a receiver so that a chamber of the receiver is in communication with the breech section;

inserting a muzzle insert at a muzzle end of the barrel section;

mounting a magazine tube to the barrel assembly using a locking ring; and mounting a ventilated rib on the barrel section;

wherein the breech section and the barrel section form a barrel assembly having a length, a length of the breech section being between one quarter to one third the length of the barrel assembly; and wherein attaching a downbore end of the breech section to a rear end of the barrel section comprises attaching the composite bore tube to a barrel connector, the locking ring comprising a part of the barrel connector.

12. A method of making a shotgun, comprising:

forming a tapered breech section, wherein forming the breech section comprises machining a metallic tube;

forming a shotgun barrel section including a composite bore tube;

attaching a downbore end of the breech section to the composite bore tube of the barrel section with a barrel connector including a locking ring, the breech section and barrel section defining a barrel assembly;

attaching a rear end of the breech section to a receiver so that a chamber of the receiver is in communication with the breech section;

mounting a magazine tube to the barrel assembly using the locking tube; and inserting a muzzle insert at a muzzle end of the barrel section, wherein the breech section and the barrel section form the barrel assembly having a length, a length of the breech section being at least one quarter the length of the barrel assembly.

13. The method of claim 12, further comprising mounting a magazine tube under the barrel assembly using a locking ring.

14. The method of claim 12, further comprising mounting a ventilated rib section on the barrel section.

15. The method of claim 12, wherein the length of the breech section is between eight to ten inches.

16. The method of claim 12, wherein forming the barrel section comprises at least one of roll wrapping, pultrusion, and winding together strips of a unidirectional fabric material about a mandrel.

17. The method of claim 12, wherein the composite bore tube is attached to the barrel connector with adhesive.

18. A method of making a shotgun, comprising:

forming a breech section, wherein forming the breech section comprises machining a metallic bar;

forming a shotgun barrel section including a composite bore tube;

attaching a barrel connector at a downbore end of the breech section to a rear end of the composite bore tube of the barrel section;

attaching a rear end of the breech section to a receiver so that a chamber of the receiver is in communication with the breech section;

mounting a magazine tube to the barrel and breech sections using a locking ring of the barrel connector; and mounting a ventilated rib on the barrel section, wherein the breech section and the barrel section form a barrel assembly having a length, a length of the breech section being at least one quarter the length of the barrel assembly.

19. The method of claim 18, wherein forming the barrel section comprises at least one of roll wrapping, pultrusion, and winding together strips of a unidirectional fabric material about a mandrel.

20. The method of claim 18, wherein the composite bore tube is attached to the barrel connector with adhesive.

21. The method of claim 18, wherein the breech section is tapered.

22. A method of making a shotgun, comprising:

forming a metallic breech section;

forming a shotgun barrel section including a composite bore tube;

attaching a downbore end of the breech section to a rear end of the composite bore tube of the barrel section with a barrel connector to form a barrel assembly, the barrel connector comprising a locking ring;

inserting a muzzle insert at a muzzle end of the barrel section;

mounting a magazine tube to the barrel assembly with the locking ring of the barrel connector and to a receiver;

mounting a ventilated rib on the barrel section; and attaching a rear end of the breech section to the receiver so that a chamber of the receiver is in communication with the breech section.

* * * * *